US008528115B2

(12) United States Patent
Damon et al.

(10) Patent No.: US 8,528,115 B2
(45) Date of Patent: Sep. 10, 2013

(54) ZIPPER ARRANGEMENT WITH FOLDABLE PULL

(75) Inventors: Jonas K. Damon, New York, NY (US); Alis Ayse Cambol, Brooklyn, NY (US); Daniel A. Sanchez, Brooklyn, NY (US)

(73) Assignee: Under Armour, Inc., Baltimore, MD (US)

( * ) Notice: Subject to any disclaimer, the term of this patent is extended or adjusted under 35 U.S.C. 154(b) by 107 days.

(21) Appl. No.: 12/947,685

(22) Filed: Nov. 16, 2010

(65) Prior Publication Data

US 2012/0117709 A1 May 17, 2012

(51) Int. Cl.
*A41D 3/02* (2006.01)

(52) U.S. Cl.
USPC ..... 2/96; 24/429

(58) Field of Classification Search
USPC ..... 2/85, 128, 311, 312, 321, 234, 96, 2/405; 24/429, 415, 436, 387, 420, 430, 24/419
See application file for complete search history.

(56) References Cited

U.S. PATENT DOCUMENTS 3,047,925 A * 8/1962 Merino ..... 24/419
3,448,463 A * 6/1969 Milone ..... 2/234
3,641,634 A * 2/1972 Asai ..... 24/429
3,754,306 A * 8/1973 Cirone ..... 24/431
4,015,296 A * 4/1977 Malick ..... 2/239
4,142,275 A 3/1979 Krauer
4,232,429 A 11/1980 Friedberg
4,261,082 A 4/1981 Kamiya
4,309,798 A 1/1982 Fraga
4,713,946 A 12/1987 Hoerkens
4,819,308 A 4/1989 Baroky
4,918,794 A * 4/1990 Harvey et al. ..... 24/429
4,922,585 A 5/1990 Suzuki et al.
4,928,358 A * 5/1990 Ishii et al. ..... 24/431
4,928,363 A * 5/1990 Easton ..... 24/390
4,949,434 A * 8/1990 Minami ..... 24/429
4,997,222 A 3/1991 Reed
5,020,247 A 6/1991 Barret et al.
5,079,809 A 1/1992 Teich et al.
5,081,747 A 1/1992 Takizawa et al.
5,181,299 A 1/1993 Huang
5,263,201 A * 11/1993 Hood ..... 2/234
5,371,927 A * 12/1994 Aussedat ..... 24/429
5,497,535 A 3/1996 Kloor
5,940,941 A 8/1999 Dishner et al.
5,956,819 A 9/1999 Terasaki et al.
5,983,465 A 11/1999 Wakai et al.
6,026,546 A 2/2000 Lund et al.

(Continued)

*Primary Examiner* — Khoa Huynh
*Assistant Examiner* — Andrew W Collins
(74) *Attorney, Agent, or Firm* — Maginot, Moore & Beck LLP

(57) ABSTRACT

A garment with a zipper arrangement includes a collar, a plurality of right zipper elements provided along a front right portion of the garment, and a plurality of left zipper elements provided along the front left portion of the garment. A slider includes a front side, a top side, and a back side. The slider is configured to slide up as far as the collar and bring the plurality of right zipper elements into engagement with the plurality of left zipper elements. The slider is further configured to slide down and disengage the plurality of right zipper elements from the plurality of left zipper elements. A flexible pull member is coupled to the slider. The flexible pull member is designed and dimensioned to extend over the top side of the slider and be releasably coupled to an inner portion of the garment when the slider is at the collar.

19 Claims, 11 Drawing Sheets

(56) References Cited

U.S. PATENT DOCUMENTS

| | | | | |
|---|---|---|---|---|
| 6,026,547 | A * | 2/2000 | O'Donnell Kiely | 24/433 |
| 6,182,338 | B1 | 2/2001 | Watanabe | |
| 6,189,249 | B1 * | 2/2001 | Hughes | 40/662 |
| 6,243,926 | B1 | 6/2001 | Takashima et al. | |
| 6,279,209 | B1 | 8/2001 | Kang | |
| 6,430,785 | B1 | 8/2002 | Matsushima et al. | |
| 6,453,521 | B1 | 9/2002 | Dischler | |
| 6,490,770 | B1 | 12/2002 | Matsuda et al. | |
| 6,499,200 | B1 | 12/2002 | Yamagishi et al. | |
| 6,536,084 | B2 | 3/2003 | Davis | |
| 6,571,432 | B1 | 6/2003 | Rindle | |
| 6,588,072 | B1 | 7/2003 | Lin | |
| 6,604,263 | B1 | 8/2003 | Dischler | |
| 6,681,456 | B1 | 1/2004 | Dischler | |
| 6,701,584 | B2 | 3/2004 | Metzger | |
| 6,851,162 | B2 | 2/2005 | Yuki et al. | |
| 6,976,293 | B2 | 12/2005 | Traulle et al. | |
| 7,017,242 | B2 | 3/2006 | Bernasconi | |
| 7,028,345 | B2 * | 4/2006 | Waldman | 2/468 |
| 7,036,190 | B2 | 5/2006 | Demarest | |
| 7,043,802 | B2 | 5/2006 | Moeller et al. | |
| 7,111,714 | B1 | 9/2006 | Bell, III | |
| 7,114,224 | B2 | 10/2006 | Kondo et al. | |
| 7,137,177 | B2 | 11/2006 | Fujii et al. | |
| 7,152,438 | B2 | 12/2006 | Matsuda | |
| 7,188,395 | B2 | 3/2007 | Kondo et al. | |
| 7,200,900 | B2 | 4/2007 | Berns | |
| 7,204,001 | B2 | 4/2007 | Lin | |
| 7,293,334 | B2 | 11/2007 | Metzger | |
| 7,313,847 | B1 | 1/2008 | Felix et al. | |
| 7,353,570 | B2 | 4/2008 | Himi | |
| 7,404,240 | B2 | 7/2008 | Nedbal et al. | |
| 7,621,025 | B2 | 11/2009 | Sanna | |
| 7,665,194 | B2 | 2/2010 | Iwase | |
| 2001/0004787 | A1 | 6/2001 | Nagata et al. | |
| 2001/0025384 | A1 * | 10/2001 | Kester | 2/89 |
| 2003/0056342 | A1 | 3/2003 | Iwase et al. | |
| 2003/0070206 | A1 * | 4/2003 | Palumbo | 2/86 |
| 2003/0177616 | A1 | 9/2003 | Petravic et al. | |
| 2004/0020017 | A1 | 2/2004 | Nedbal et al. | |
| 2004/0074059 | A1 | 4/2004 | Traulle et al. | |
| 2004/0088834 | A1 | 5/2004 | Yu | |
| 2004/0117954 | A1 | 6/2004 | Lin | |
| 2004/0148745 | A1 | 8/2004 | Moeller et al. | |
| 2005/0102803 | A1 | 5/2005 | Wen et al. | |
| 2005/0166371 | A1 | 8/2005 | Tseng et al. | |
| 2005/0204517 | A1 | 9/2005 | Demarest | |
| 2006/0107441 | A1 * | 5/2006 | Houdroge | 2/227 |
| 2006/0143797 | A1 * | 7/2006 | Waldman | 2/202 |
| 2006/0218758 | A1 | 10/2006 | Chang | |
| 2006/0242804 | A1 | 11/2006 | Griffiths | |
| 2007/0107171 | A1 | 5/2007 | Kojima | |
| 2007/0135953 | A1 | 6/2007 | Crow | |
| 2007/0226871 | A1 * | 10/2007 | Hood | 2/69 |
| 2007/0289110 | A1 | 12/2007 | Bekeschus | |
| 2008/0040837 | A1 * | 2/2008 | King et al. | 2/227 |
| 2008/0127395 | A1 * | 6/2008 | Blauer et al. | 2/87 |
| 2008/0155797 | A1 | 7/2008 | Tamura | |
| 2008/0209695 | A1 | 9/2008 | Matsui et al. | |
| 2008/0222854 | A1 | 9/2008 | Keyaki et al. | |
| 2009/0013505 | A1 | 1/2009 | Hasegawa et al. | |
| 2009/0049659 | A1 | 2/2009 | Takani et al. | |
| 2009/0056086 | A1 | 3/2009 | Ujihara et al. | |
| 2009/0077774 | A1 | 3/2009 | Lee et al. | |
| 2009/0229090 | A1 | 9/2009 | Cossutti et al. | |
| 2009/0320250 | A1 | 12/2009 | Yamamoto et al. | |
| 2010/0005557 | A1 | 1/2010 | Cossutti et al. | |

* cited by examiner

ZIPPER ARRANGEMENT WITH FOLDABLE PULL

FIELD

This application relates to the field of fastening devices, and particularly to zipper arrangements.

BACKGROUND

Zippers are commonly used to fasten opposing fabric portions. One typical use for zippers is to close two separate fabric portions on the front of a garment such as a coat or jacket.

When closing a garment using known zipper arrangements on the front of a garment, the wearer must move a slider to the bottom of the garment and position it immediately above a retaining box. The wearer must then feed a small insertion pin on one side of the zipper through the slider and into the retaining box on the opposite side of the zipper. Once the insertion pin is fed through the slider and has engaged the retainer box, the wearer can pull the slider by gripping a pull tab and pulling the slider upward. The slider brings teeth on opposite sides of the zipper together and forces the teeth into interlocking engagement with each other.

The small size of the insertion pin and retaining box often makes it difficult to quickly couple the insertion pin and retaining box. This is especially true when the garment is bulky, such as a winter coat, or when the wearer has impeded contact with the retaining box and the insertion pin because he or she is wearing gloves. Users with mobility limiting medical conditions, such as arthritis, may also have difficulty coupling the insertion pin and the retaining box. Moreover, the relatively remote location of the insertion pin and retaining box at the bottom of the garment may make it difficult for the wearer to see the parts. This is especially true if the parts are somewhat blocked from view by a bulky garment, or if the wearer has poor eyesight.

When moving the slider upward to close the garment or downward to open the garment, the user of the zipper arrangement receives some feedback from the feel of the slider moving along the teeth. A smooth, freely moving feel typically indicates that the zipper is functioning properly. A rough, high friction feel may indicate an issue with the zipper. For example, it is not uncommon for a portion of the garment to be snagged within the slider as the slider is moved upward to close the zipper or downward to open the zipper, thus limiting free movement of the slider. The snagging of the garment can be frustrating for the user as well as cause damage to the garment or the zipper.

In addition to issues related to zipper coupling and sliding action, zipper comfort is sometimes an issue. In particular, in a garment with a zipper that extends to the collar, the slider may cause discomfort when it is moved to the upmost position in the collar area. Here, the relatively hard slider may rub against the skin on the wearer's neck and cause discomfort to the wearer. Additionally, when the garment is worn in cold weather, the typically metallic slider will become cold, and simple contact of the metallic slider against the wearer's skin will result in a cold feeling at the neck of the wearer.

In view of the foregoing, it would be advantageous to provide zipper arrangements where the components may be more easily accessed and assembled by the wearer. It would also be advantageous to provide a zipper arrangement with improved tactile feel while also reducing the chance of the garment becoming snagged within the slider as the slider is moved up or down. It would also be advantageous to provide a zipper arrangement that provides improved comfort when the slider is moved to various locations on the garment.

SUMMARY

As disclosed herein, in at least one embodiment a garment with a zipper arrangement includes a collar, a plurality of right zipper elements provided along a front right portion of the garment, and a plurality of left zipper elements provided along the front left portion of the garment. A slider includes a front side, a top side, and a back side. The slider is configured to slide up as far as the collar and bring the plurality of right zipper elements into engagement with the plurality of left zipper elements. The slider is further configured to slide down and disengage the plurality of right zipper elements from the plurality of left zipper elements. A flexible pull member is coupled to the slider. The flexible pull member is designed and dimensioned to extend over the top side of the slider and be releasably coupled to an inner portion of the garment when the slider is at the collar. In at least one embodiment, the inner portion of the garment is an inside portion of the collar. In at least one alternative embodiment, inner portion of the garment is the back side of the slider. Various retention members may be used to releasably couple the pull member to the inner portion of the garment, including a magnet or a hook and loop fastener.

In association with the zipper arrangement disclosed herein, a method of closing a garment includes moving a slider in an upward direction on the garment in order to engage a plurality of right zipper elements with a plurality of left zipper elements provided a front of the garment. The method further includes stopping movement of the slider in the upward direction when the slider reaches a collar of the garment before folding the flexible pull member over the upper portion of the slider. Thereafter, the method includes folding a flexible pull member over an upper portion of the slider and releasably coupling the flexible pull member to an inner portion of the garment.

The above described features and advantages, as well as others, will become more readily apparent to one of ordinary skill in the art by reference to the following detailed description and accompanying drawings. While it would be desirable to provide a garment with a zipper arrangement that provides one or more of these or other advantageous features, the teachings disclosed herein extend to those embodiments which fall within the scope of the appended claims, regardless of whether they accomplish one or more of the above-mentioned features or advantages.

DESCRIPTION

Various embodiments of zipper arrangements are provided within this disclosure which address limitations of prior art zipper arrangements. Included in these zipper arrangements is a zipper arrangement with an insertion pin assembly aimed at improving the ability of a wearer to bring opposite sides of the zipper arrangement together to begin operating the zipper arrangement. Also included in this disclosure is an embodiment of a zipper arrangement aimed at reducing chances of the garment being snagged by the zipper arrangement while also improving the tactile feel of a slider. This zipper arrangement includes wheels within the slider that urge engagement or disengagement of teeth as the slider is moved along the length of the zipper arrangement. Further included in this disclosure is a zipper arrangement that includes a foldable pull tab for cases where the zipper arrangement extends to the wearer's neck.

Insertion Pin Assembly with a Funnel Opening

Figure 1:
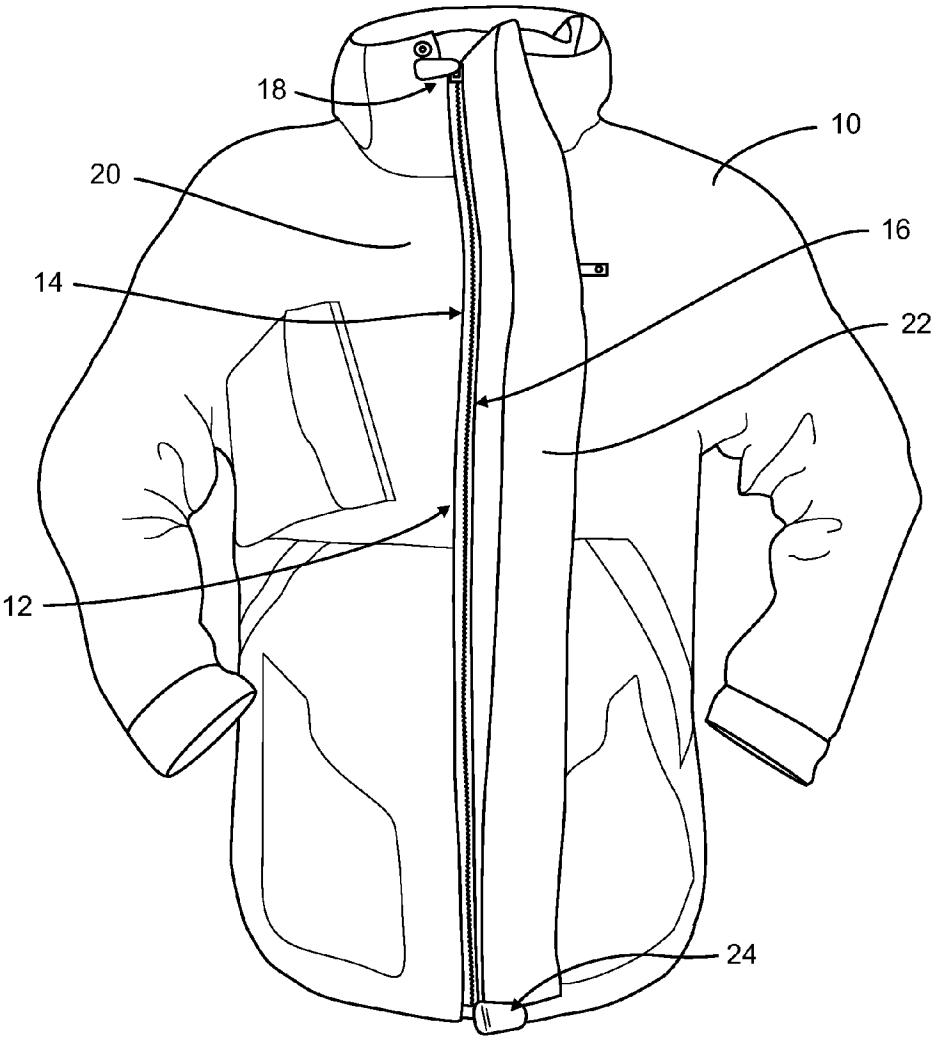
FIG. 1 shows a front view of a zipper arrangement provided on a garment with opposing sides of the zipper arrangement coupled such that the garment is closed.
Figure 2:
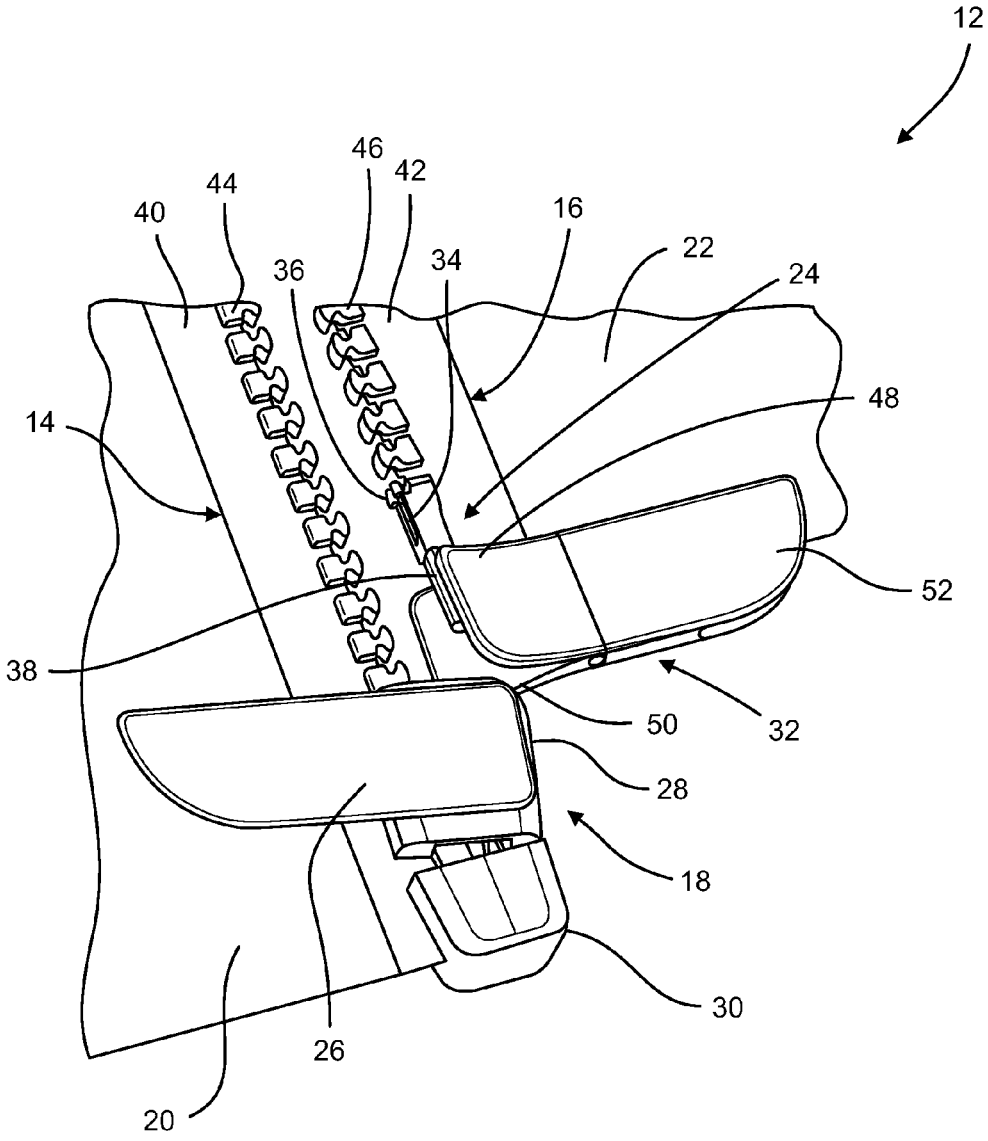
FIG. 2 shows a perspective view of a slider assembly and an insertion pin assembly of the zipper arrangement of FIG. 1, with the slider assembly and insertion pin assembly in an unengaged state.

With reference to FIGS. 1 and 2, a garment 10 is shown with a zipper arrangement 12 provided on a front portion of the garment 10. The zipper arrangement 12 includes a right side 14 and a left side 16. A slider assembly 18 is moveably positioned on the right side 14 of the zipper arrangement 12. An insertion pin assembly 24 is fixedly coupled to the bottom of the left side 16 of the zipper arrangement.

The garment 10 is shown in FIG. 1 in the form of a jacket including a front right portion 20 and a front left portion 22. The front right portion 20 and the front left portion 22 are generally separated from each other on the front of the garment 10, but are configured to be fastened together with the zipper arrangement 12. When the front right portion 20 and front left portion 22 are separated, a wearer may easily insert his or her arms into the sleeves of the garment 10 and put on the garment 10. The wearer may then use the zipper arrangement 12 to join the front right portion 20 to the front left portion 22. While the garment 10 has been shown in the embodiment of FIG. 1 as a jacket, it will be recognized that the garment 10 may take any of various other forms, such as a coat, shirt, pants, or any other garment that may have one or more portions with edges to be releasably coupled together with the zipper arrangement 12. Additionally, while the zipper arrangement 12 has been shown in the front of the garment in FIG. 1, it will be recognized that the zipper arrangement 12 may be provided in any location on the garment 10 where the edges of two garment portions will be releasably coupled together. Moreover, while various embodiments of the zipper arrangement 12 have been shown herein in association with a garment 10, it will be recognized that the zipper arrangement 12 may be used in association with numerous other articles, including for example, bags, shoes, tents, etc.

With continued reference now to FIGS. 1 and 2, the right side 14 of the zipper arrangement 12 is coupled to an edge of the front right portion 20 of the garment 10, and the left side 16 of the zipper arrangement 12 is coupled to an edge of the front left portion 22 of the garment 10. The right side 14 includes a tape 40 with zipper elements 44 (which may also be referred to herein as "teeth") positioned along the length of the tape 40. Similarly, the left side 16 includes a tape 42 with zipper elements 46 positioned along the length of the tape 42. The zipper elements 44 on the right side 14 are generally parallel to each other and extend away from the tape 40 toward the left side 16 of the zipper arrangement 12. Similarly, the zipper elements 46 on the left side 16 are generally parallel to each other and extend away from the tape 42 toward the right side 14 of the zipper arrangement 12. The zipper elements 44 on the right side 14 are configured to interlock with the zipper elements 46 on the left side 16 when the zipper arrangement 12 is closed by movement of the slider assembly 18 along the teeth 44, thereby coupling the front right portion 20 of the garment 10 to the front left portion 22 of the garment 10.

A perspective view of a lower portion of the zipper arrangement 12 is shown in FIG. 2 including the slider assembly 18 and the insertion pin assembly 24. The slider assembly 18 includes a slider 28 with a pull tab 26 that is pivotably coupled to the slider 28. The slider 28 is slideably attached to the right side 14 of the zipper arrangement 12. A retainer box 30 is fixedly coupled to the bottom right side 14 of the zipper arrangement 12 and is configured to provide a stop for the slider 28 at the lower end of the zipper arrangement 12.

The insertion pin assembly 24 is stationary on the left side 16 of the tape 42 and includes a grip member 32 with an insertion pin 38 positioned adjacent the grip member 32. The insertion pin 38 is an elongated box shaped member that is generally rigid and dimensioned for insertion into the slider 28 and the retainer box 30. A flexible transition member 34 is provided above the insertion pin 38. The flexible transition member 34 spans between the insertion pin 38 and the teeth 46 on the left side 16 of the zipper arrangement 12. A first tooth 36 is provided at the top of the flexible transition member 34. As described further below, with the slider 28 in contact with the retainer box 30, the insertion pin 38 is configured to be inserted into the slider 28 and further into the retainer box 30. Accordingly, when the insertion pin 38 is bottomed out within the retainer box 30, the first tooth 36 above the flexible transition member 34 is at the top of the slider 28.

With continued reference to FIG. 2, the grip member 32 of the insertion pin assembly 24 includes an outer jaw 48 and an inner jaw 50. The outer jaw 48 and inner jaw 50 form a mouth 54 on the grip member 32. This mouth 54 is generally open to the slider 28 on the right side 16 of the zipper arrangement 12, and the insertion pin 38 is positioned within the mouth 54 between the outer jaw 48 and the inner jaw 50. Additionally, the mouth 54 is dimensioned to receive the slider 28 such that the slider 28 may be inserted at least partially into the mouth 54. Because the right edges of the outer jaw 48 and inner jaw 50 are flared away from each other, the mouth 54 provides a funnel structure configured to receive the slider 28. The flared jaws 48 and 50 result in a mouth 54 that is progressively smaller moving from right to left across the grip member 32. Accordingly, when the slider 28 is moved laterally in the direction of the mouth 54, the slider 28 may be easily inserted into the mouth 54, but then contacts the tapered inner surface of the mouth 54. As described further below, and in reference to FIGS. 3 and 5, the mouth 54 is configured to initially receive the slider 28, when the insertion pin 38 is being inserted into the slider 28 and the retainer box 30. Thereafter, the mouth 54 is designed to allow the slider 28 to pass upward and completely through the mouth 54 as the insertion pin 38 is inserted deeper into the retainer box 30.

A handle portion 52 is provided on the opposite side of the grip member 32 from the mouth 54. The handle portion 52 includes two generally smooth surfaces on the inner and outer sides of the grip member 32 that provide an inner grip surface and an outer grip surface that may be grasped by the wearer's fingers and thumb. Accordingly, the handle portion 52 is dimensioned to provide a surface that is sufficiently sized to receive substantially the entire pad of a man's or woman's thumb. The flared structure of the outer jaw 48 and inner jaw 50 result in a curved surface on the right side of the handle portion 52 that transitions into a generally flat surface on the left side of the handle portion 52.

Figure 3:
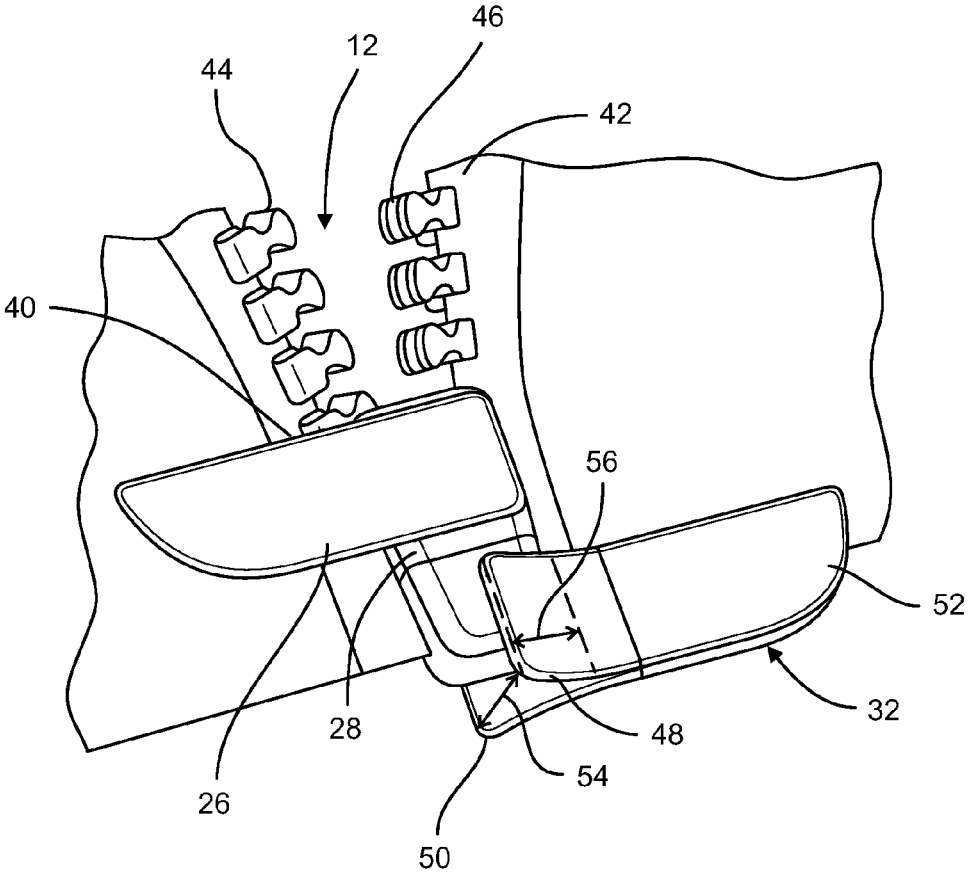
FIG. 3 shows a perspective view of the slider assembly and the insertion pin assembly of FIG. 2 in an engaged state.

With reference to FIG. 3, a perspective view of the zipper arrangement 12 is shown with the slider 28 seated against the retainer box 30 and the insertion pin 38 bottomed out in the retainer box 30. A rightmost edge of the outer jaw 48 of the grip member 32 and a rightmost edge of the inner jaw 50 of the grip member 32 are spaced apart and define an opening to the mouth 54. The opening is larger than thicknesses of the slider 28 or the retainer box 30. Therefore, the slider 28 can easily be positioned within the opening to the mouth 54. Due to the curved nature of the outer jaw 48 and the inner jaw 50, the opening to the mouth 54 decreases when moving toward the left within the mouth 54. When the slider 28 is moved a distance 56 into the mouth 54, separation between the outer jaw 48 and the inner jaw 50 is smaller than the thickness of the slider 28 or the retainer box 30. Therefore, the insertion pin assembly 24 can only receive the slider 28 and the retainer box 30 into the mouth 54 up to the point shown by the distance 56.

Figure 4:
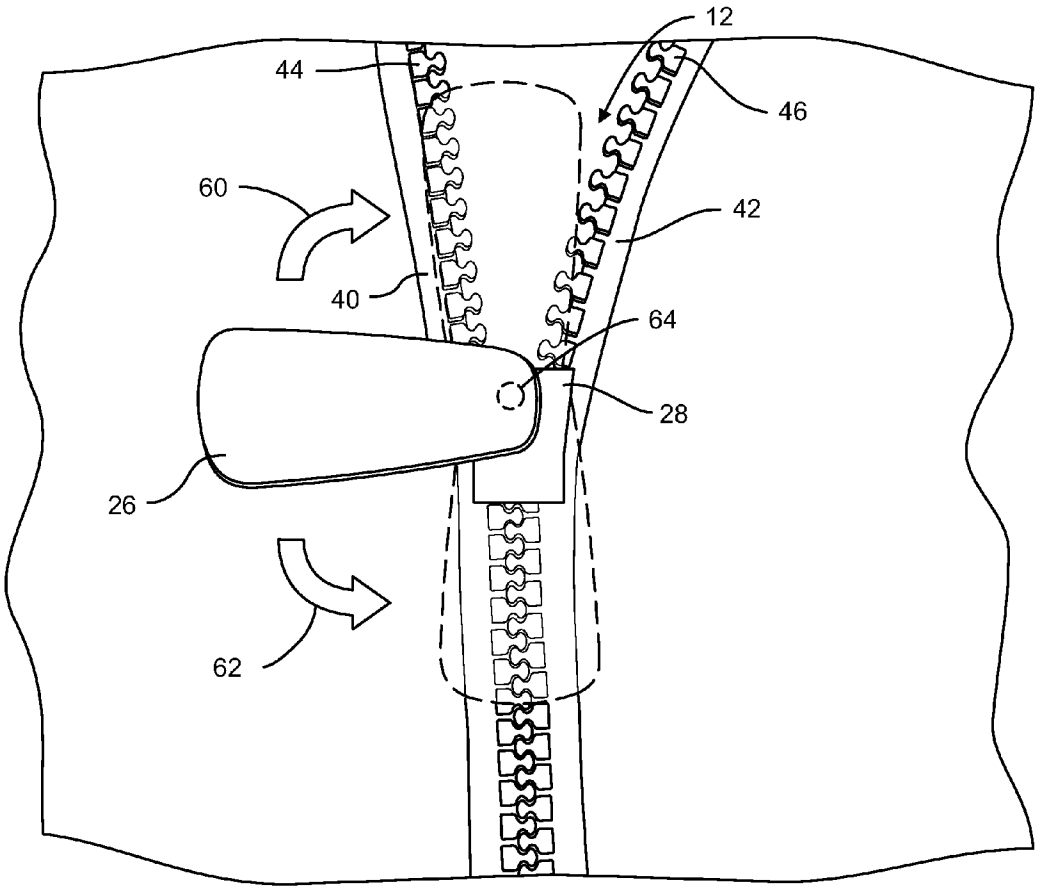
FIG. 4 shows a front view of a pull tab of the slider assembly of FIG. 3 in several pivotable positions.

Referring to FIG. 4, a front view of the zipper arrangement 12 is shown with the zipper arrangement 12 partially closing the garment 10. Like the handle portion 52, the pull tab 26 is also dimensioned to provide two opposing surfaces that are sufficiently sized to receive substantially all of the pad of a man's thumb, thus allowing the wearer to easily grasp and manipulate the pull tab 26. The pull tab 26 is shown in FIG. 4 in various rotational positions about the slider 28. Specifically, three positions of the pull tab 26 are shown in FIG. 4. The pull tab 26 is configured to rotate according to an arrow 60 from a rightwardly oriented horizontal position to an upwardly oriented vertical position. Similarly, the pull tab 26 can be rotated to a downwardly oriented vertical position from the rightwardly oriented horizontal position according to an arrow 62. The pull tab 26 can also rotate to a leftwardly oriented horizontal position, however, for clarity of the drawing, this position is not shown. A pin 64 (shown in phantom) couples the pull tab 26 to the slider 28 and allows the pull tab 26 to pivot with respect to the slider 28. Also, the pull tab 26 may optionally include a frictional member (not shown) positioned on the underside of the pull tab 26 which interfaces with an associated frictional member (not shown) positioned on the slider 28. These frictional members help retain the pull tab 26 in the positions shown in FIG. 4 against pull of gravity.

Figure 5:
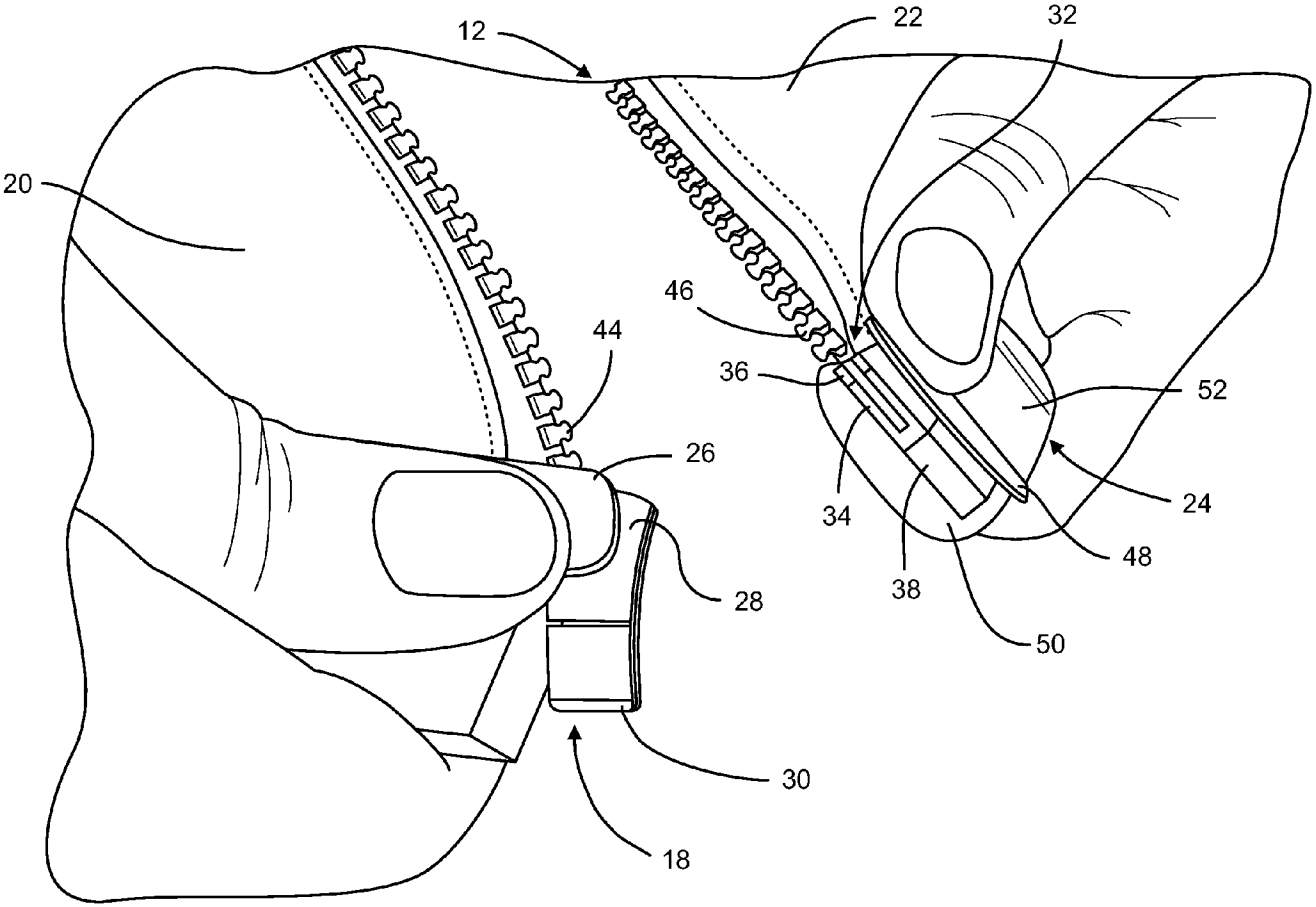
FIG. 5 shows a perspective view of a wearer gripping the slider assembly and the insertion pin assembly of the zipper arrangement of FIG. 1 in the process of engaging the insertion pin assembly with the slider assembly.

Operation of the zipper arrangement 12 is described with reference to FIG. 5, which shows a wearer in process of engaging the slider assembly 18 with the insertion pin assembly 24. During this process, the wearer of the garment 10 grips the slider assembly 18 by gripping the pull tab 26 with the wearer's right hand. The wearer also grips the grip member 32 of the insertion pin assembly 24 with the wearer's left hand. Given the size of the pull tab 26 and its predictable position with respect to the slider 28, the wearer can quickly locate the slider assembly 18 with his or her right hand. Additionally, the outer and inner jaws 48 and 50 of the insertion pin assembly 24 allow the wearer to quickly locate the position of the insertion pin assembly 24 and associated insertion pin 38 with the wearer's left hand, even if the wearer has impeded visibility or impeded ability to grip the insertion pin assembly 24.

Once the wearer has located the slider assembly 18 and the insertion pin assembly 24, the wearer can bring the two sides of the zipper arrangement 12 together. As described above, the mouth 54 of the grip member 32 is configured to receive the slider assembly 18 up to a point within the funnel-like opening that is defined by the distance 56 (see FIG. 3). Therefore, the insertion pin assembly 24 is advantageously configured to provide a function to assist in locating the insertion pin 38 within the slider assembly 18. This function is particularly helpful when the wearer has impeded visibility or impeded ability to grip the slider assembly 18 and the insertion pin assembly 24.

After the wearer brings the slider assembly 18 and the insertion pin assembly 24 together, the wearer can easily align the insertion pin 38 with an opening (not shown) of the slider 28 by adjusting the position of the insertion pin assembly 24 while maintaining pressure between the slider assembly 18 and the insertion pin assembly 24. Once aligned, the wearer can move the insertion pin assembly 24 downward relative to the slider assembly 18 in order to insert the insertion pin 38 into the slider 28 and then further into the retainer box 30 until the insertion pin 38 bottoms out within the retainer box 30. In order to close the garment 10, the wearer can then move the slider 28 along the length of the zipper arrangement 12 to engage teeth 44 and 46 (see FIG. 4) on the right side 14 and the left side 16 of the zipper arrangement 12.

Slider with Wheels

Figure 6:
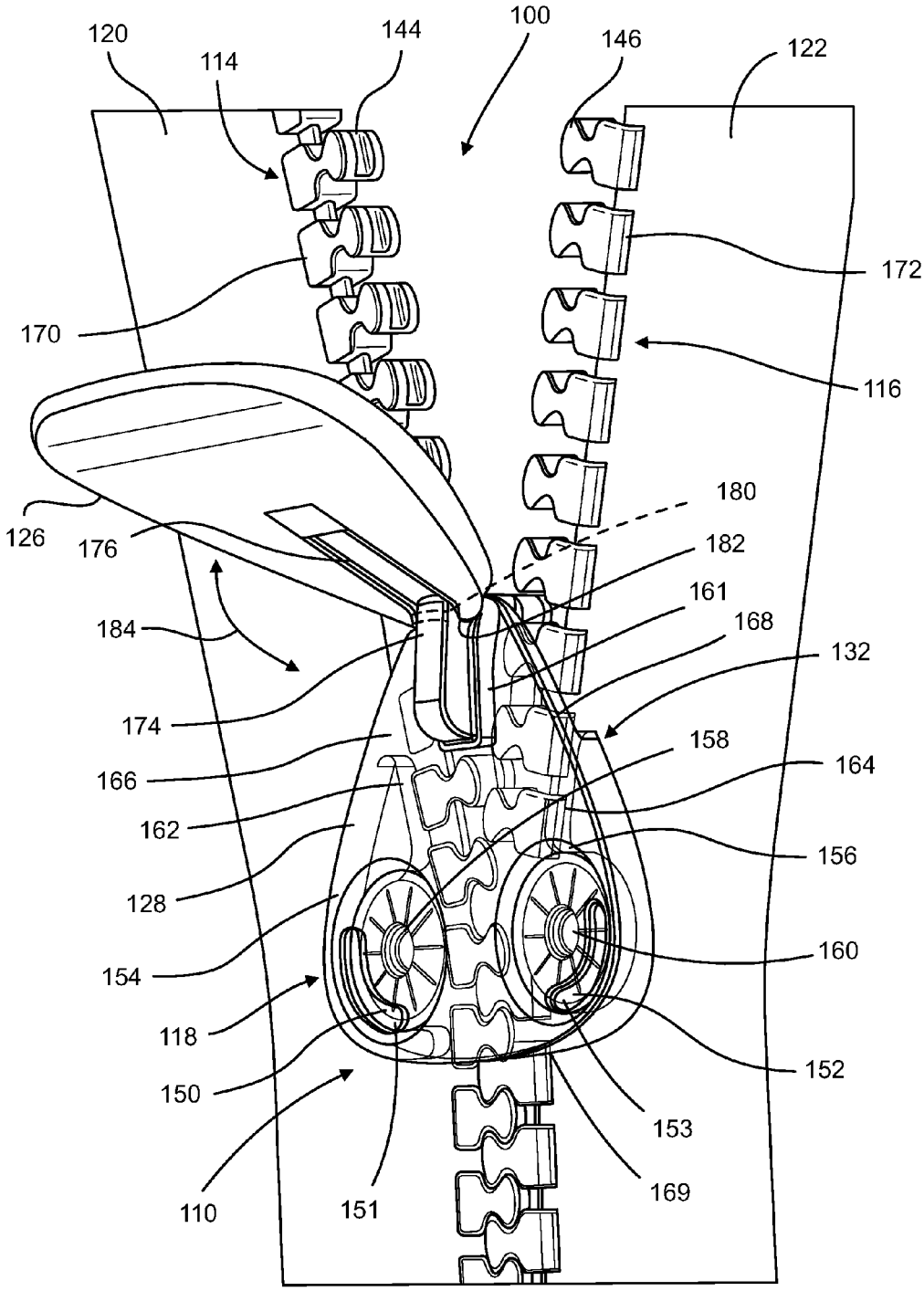
FIG. 6 shows a perspective view of a wheeled zipper arrangement provided on a garment with opposing sides of the zipper arrangement coupled such that the garment is partially closed.

Referring to FIG. 6, an alternative embodiment of a zipper arrangement 100 is shown provided on a garment 110. Similar to the zipper arrangement 12 shown in FIGS. 1-5, the zipper arrangement 100 is provided on front of the garment 10 and includes a right side 114 and a left side 116. A slider assembly 118 is provided on the right side 114 which is configured to engage with the left side 116 of the zipper arrangement 100.

The garment 110, similar to the garment 10 of FIGS. 1-5, includes a front right portion 120 and a front left portion 122. The garment 110 may take any of various forms, such as a coat, a shirt, pants, or any other garment that may have one or more portions with edges to be releasably coupled together with the zipper arrangement 100. Furthermore, while the zipper arrangement 100 has been shown herein in association with a garment 110, it will be recognized that the zipper arrangement 100 may be used in association with numerous other articles, including for example, bags, shoes, tents, etc.

The slider assembly 118 includes a slider 128 having a generally trapezoidal or triangular perimeter shape and an associated pull tab 126 also having a similar trapezoidal or triangular perimeter shape. It will be recognized that the shape of the slider 128 is different from the conventional Y-shaped slider. With conventional Y-shaped sliders, the upper end of the slider is wider and configured to pass the disengaged teeth into and out of the slider, while the lower end is thinner and configured to pass engaged teeth into and out of the slider. In contrast, the slider 128 disclosed herein has a generally inverted arrangement from the typical Y-shaped slider. In particular, the bottom end of the slider 128 is wider than the upper end. Thus, with slider 128 disclosed the end of the slider that is configured to pass engaged teeth into and out of the slider 128 is wider than the end of the slider that is configured to pass disengaged teeth into and out of the slider 128.

The slider 128 has an internal chamber 132 which includes cavities 154 and 156. Within the cavity 154 is a right wheel 150 that can be viewed through an arcuate window 151. The right wheel 150 is configured to rotate about a hub 160 within the cavity 154. Similarly, within the cavity 156 is a left wheel 152 that can be viewed through an arcuate window 153. The left wheel 152 is configured to rotate about a hub 162 within the cavity 156. As the slider 128 is moved and teeth 144 and 146 move through the slider 128, the wheels 150 and 152 make contact with the backsides 170 and 172 of the teeth 144 and 146. The contact with the backsides 170 and 172 of the teeth 144 and 146 results in a slight pivoting of the teeth 144 and 146 as they are moved into and out of engagement with each other. In particular, when the slider 128 is moved in an engagement direction (i.e., upward in the embodiment of FIGS. 6-8), the engagement of the wheels 150 and 152 with the backsides 170 and 172 of the teeth 144 and 146 cause the teeth 144 and 146 to pivot toward one another and into engagement. Additionally, when the slider 128 is moved in an opposite direction (i.e., downward in the embodiment of FIGS. 6-8) the contact between the wheels 150 and 152 and the backsides 170 and 172 of the teeth 144 and 146 cause the teeth 144 and 146 to pivot away from one another and out of engagement. The engagement of the wheels 150 and 152 with the backsides 170 and 172 of the teeth 144 and 146 not only facilitates engagement and disengagement of the teeth 144 and 146, but also provides a unique tactile feel for the user. This tactile feel also provides the user with an indication that the zipper arrangement 100 is functioning properly.

With continued reference to FIG. 6, the internal chamber 132 of the slider 128 also includes a right guide 162 and a left guide 164 in an upper portion of the slider. The right guide 162 is adjacent the wheel 150, while the left guide 164 is adjacent the wheel 152. The right guide 162 and the left guide 164 are configured to guide the teeth 144 and 146 on opposing sides of the zipper arrangement 100 into engagement with each other as the slider 128 is pulled upward (with respect to FIG. 7). In particular, as the teeth 144 on the right side enter a right opening 166 in the slider 128, the right guide 162 makes contact with backsides 170 of the teeth 144 and directs the teeth 144 toward the center of the slider 128, to a position between the wheels 150 and 152. Similarly, as the teeth 146 on the left side enter a left opening 168 in the slider 128, the left guide 164 makes contact with backsides 172 of the teeth 146 and direct the teeth 146 toward the center of the slider 128, to a position between the wheels 150 and 152. As the opposing teeth 144 and 146 are moved toward the center of the slider 128 and between the wheels 150 and 152, the teeth 144 and 146 are forced into engagement. Similarly, when the slider 128 is pulled downward, a triangular median member 161 positioned between the right guide 162 and the left guide 164 separates the teeth 144 and 146 as they move out from between the wheels 150 and 152 and toward the right opening 166 and the left opening 168 in the slider 128.

The internal chamber 132 also includes a central opening 169 at the bottom of the slider 128. The central opening 169 is configured to allow the teeth 144 and 146, already in an engaged state, to exit the internal chamber 132 as the slider 128 is pull upward as the zipper arrangement 100 is closed. Similarly, the central opening 169 is configured to allow the teeth 144 and 146 to enter the internal chamber 132 as the slider 128 is pulled downward as the zipper arrangement 100 is opened.

The pull tab 126 is hingedly attached to a stud 174 which is fixed with respect to the slider 128. The stud 174 can be integrally formed with the slider 128 or attached to the slider 128 as a separate component. A through hole 180 is formed in the stud 174 which is aligned with complementary partial holes (not shown) in the pull tab 126. A pin 182 is positioned in the through hole 180 which extends to the complementary partial holes (not shown) in the pull tab 126. The pin 182 enables the pull tab 126 to pivot with respect to the slider 128 according to an arrow 184.

Figure 8:
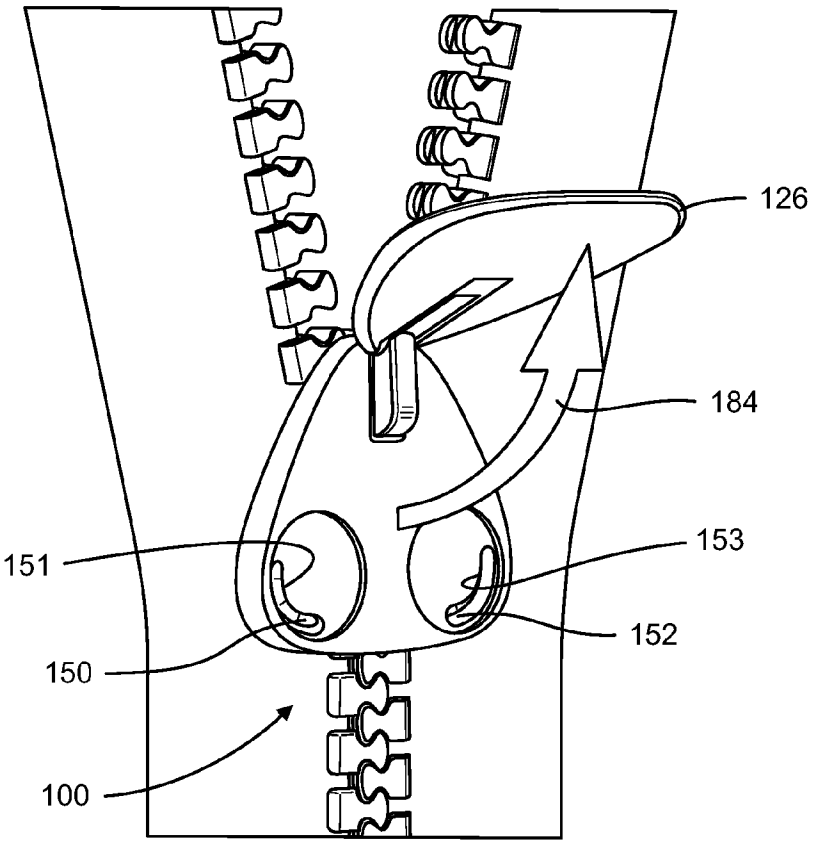
FIG. 8 shows a perspective view of the wheeled zipper arrangement of FIG. 6 with the pull tab placed in an open position revealing wheels through arcuate openings provided in a slider.
Figure 7:
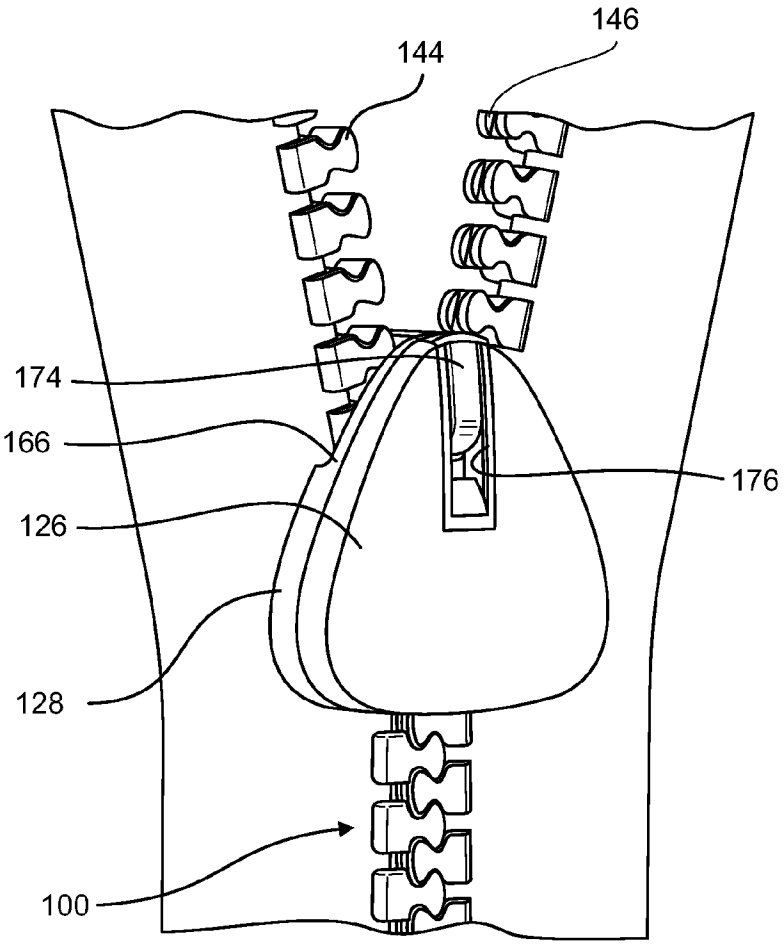
FIG. 7 shows a perspective view of the wheeled zipper arrangement of FIG. 6 with a pull tab placed in a closed position.

With reference to FIGS. 7 and 8, additional perspective views of the zipper arrangement 100 are provided. In FIG. 7, the pull tab 126 is shown in a closed position with respect to the slider 128. Because the pull tab 126 has substantially the same trapezoidal or triangular shape as the slider 128, the pull tab 126 provides a fitted covering for the slider 128 in the closed position. The combination of the pull tab 126 and the slider 128 with substantially the same perimeter shape provides a unique look for the zipper arrangement 100. FIG. 8 shows the pull tab 126 rotated upward with respect to the slider 128 in the direction of arrow 184. Arcuate windows 151 and 153 reveal the wheels 150 and 152.

Figure 9:
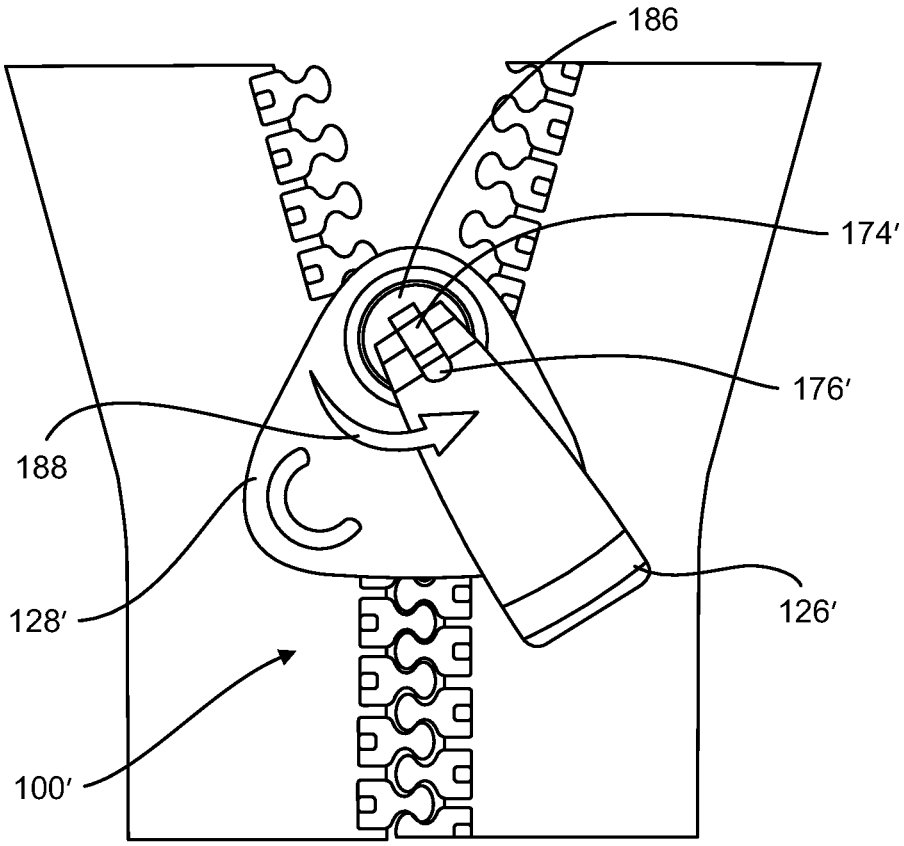
FIG. 9 shows a front view of a wheeled zipper arrangement similar to the zipper arrangement of FIG. 6 with a pull tab being rotatable with respect to a slider.

With reference now to FIG. 9, a front view of an alternative embodiment of a zipper arrangement 100' similar to the zipper arrangement 100 is shown. The zipper arrangement 100' includes a pull tab 126' and a slider 128'. The zipper arrangement 100' of FIG. 9 is substantially the same as the zipper arrangement 100 of FIGS. 6-8, except the pull tab 126' operates differently and is shaped differently. In the embodiment of FIG. 9, the slider 128' includes a stud 174' that extends through an opening 176' of the pull tab 126'. The pull tab 126' is pivotably mounted to the slider 128' by a hub 186 which allows the pull tab 126' to swing with respect to the slider 128' according to an arrow 188.

Figure 10:
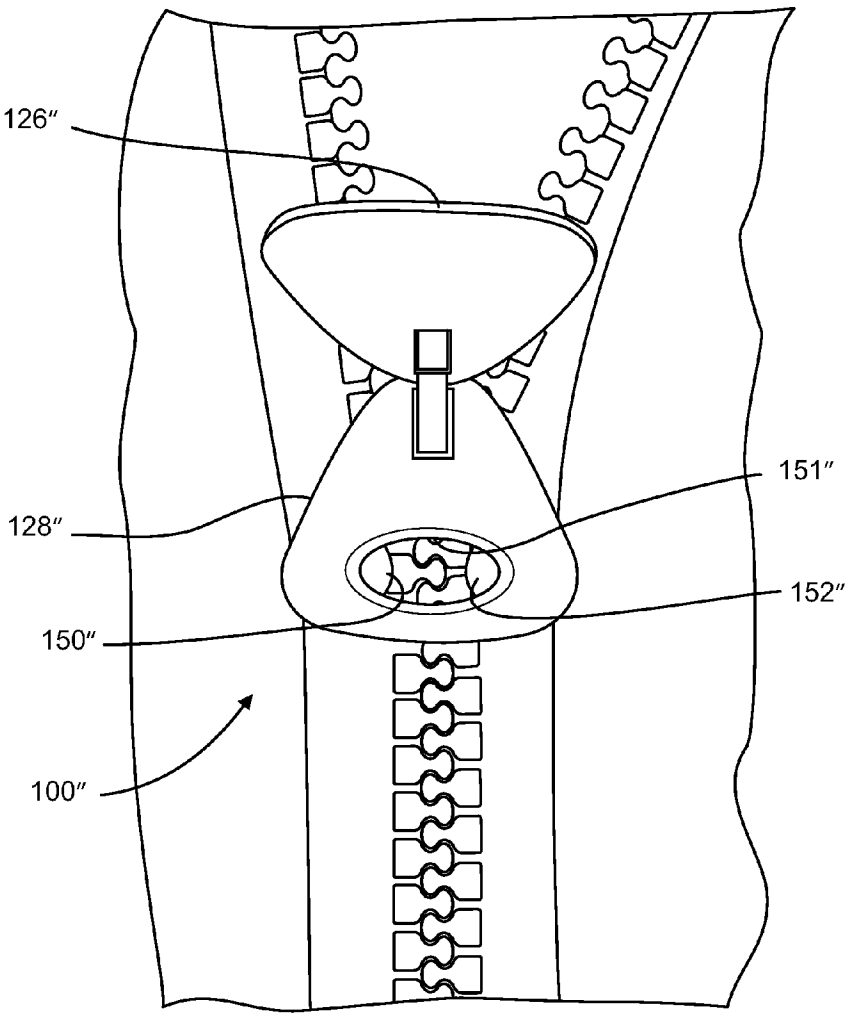
FIG. 10 shows a front view of an alternative embodiment of the wheeled zipper arrangement of FIG. 6 with a pull tab placed in an open position revealing wheels through a central window.

Referring to FIG. 10, a front view of another zipper embodiment 100" similar to the zipper arrangement 100 is shown. The zipper arrangement 100" includes a pull tab 126" which is configured to cover a slider 128" when the pull tab 126" is in a closed position. The slider 128" includes a central window 151" which reveals two wheels 150" and 152" positioned inside the slider 128". The central window 151" is oblong or oval shaped and sufficiently sized such that it reveals at least part of both wheels 150" and 152".

Operation of the zipper arrangements 100 is discussed in the following paragraphs with respect to FIGS. 6, 7, and 8. However, it will be recognized that the same operation applies to the zipper arrangements 100' and 100" (shown in FIGS. 9, and 10).

Closure Operation

As a wearer of the garment 110 grips the pull tab 126 and swings the pull tab 126 upward according to the arrow 184, the wearer of the garment 110 can move the slider 128 upward. As the slider 128 moves upward, the teeth 144 and 146 enter the right opening 166 and the left opening 168 (positioned on opposite sides of the slider 128) and into the internal chamber 132. The backsides 170 of the teeth 144 are guided by the right guide 162 and the backsides 172 of the teeth 146 are guided by the left guide 164. The right guide 162 and the left guide 164 initiate the engagement of the teeth 144 and 146 as the pull tab 126 is pulled upward.

The trapezoidal or triangular shape of the slider 128 and the shape of the right opening 166 and the left opening 168 as well as the interface between the right opening 166 and the teeth 144 and the left opening 168 and the teeth 146 urge fabric of the garment 110 from snagging within the slider 128. Specifically, the anti-snagging quality is achieved by a tight interface between the backsides 170 and 172 of the teeth 144 and 146 and the right guide 162 and the left guide 164 which reduces the chance of part of the garment 110 being snagged within the slider 128.

Furthermore, the wheels 150 and 152 make firm contact with the backsides 170 and 172 of the teeth 144 and 146. As the slider 128 is pulled up, the right wheel 150 rotates about the hub 158 in a clockwise direction, while the left wheel 152 rotates about the hub 160 in a counterclockwise direction. The wheels 150 and 152 complete the engagement of the teeth 144 and 146 and urge the engaged teeth 144 and 146 to exit out of the central opening 169 and out of the slider 128. The wheels 150 and 152 provide a "smooth" feedback to the wearer of the garment 110 as he or she pulls the pull tab 126 upward, which enhances operational feel of the zipper arrangement 100.

Opening Operation

The wearer can open the zipper arrangement 100 by pulling down on the pull tab 126. First the pull tab 126 swings toward the slider 128 about the pin 182, according to the arrow 184. Then the wearer can pull the pull tab 126 and the slider 128 downward. The right wheel 150 rotates in a counterclockwise direction about the hub 158, while the left wheel 152 rotates clockwise about the hub 160. Due to the firm contacts between the wheels 150 and 152 and the backsides 170 and 172 of the teeth 144 and 146, rotation of the wheels 150 and 152 urge an initial separation of the teeth 144 and 146. The right guide 162 and the left guide 164 and the shape of the right opening 166 and left opening 168 cause the teeth 144 and 146 to completely disengage as the slider 128 is pulled downward.

Because of the firm contact between the wheels 150 and 152 and the backsides 170 and 172 of the teeth 144 and 146, as the teeth 144 and 146 enter the central opening 169 chances for part of the fabric of the garment 110 to enter the slider 128 and be snagged within the slider 128 is substantially minimized.

Furthermore, similar to the discussion provided above, the wheels 150 and 152 generate a smooth feedback to the wearer as he or she pulls the slider 128 downward. The smooth feedback can provide a feeling of high-quality to the wearer as compared to zipper arrangements of the prior art.

Foldable Pull Tab

Figure 12:
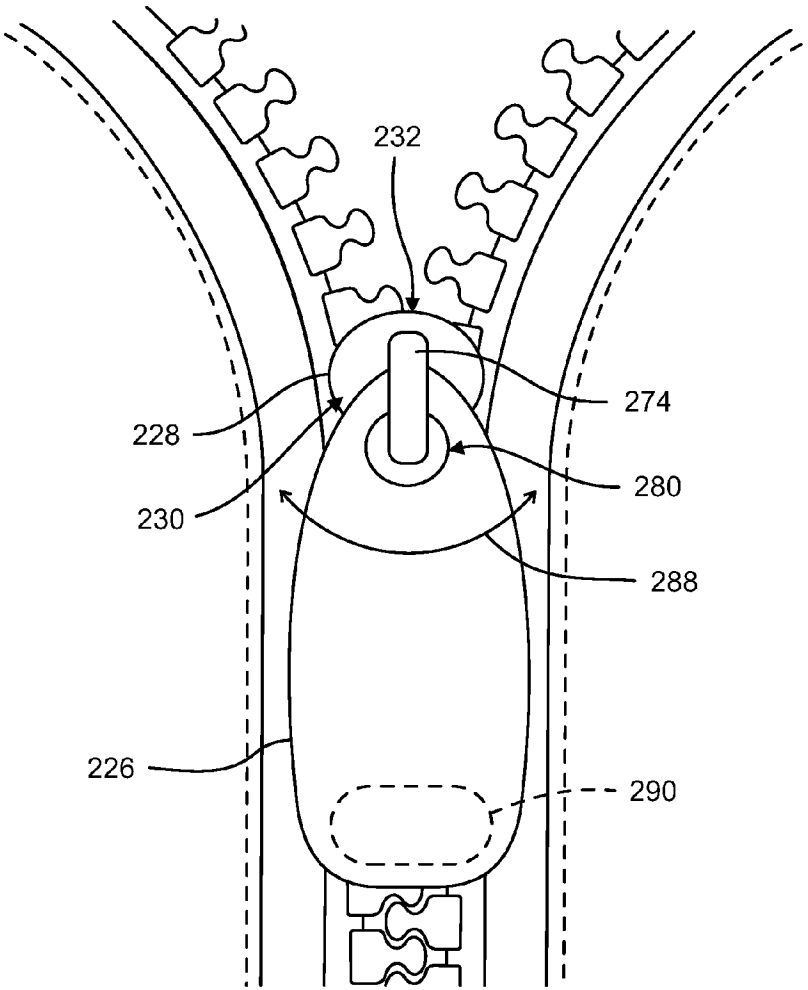
FIG. 12 shows a front view of the comfort zipper arrangement of FIG. 11 with opposing sides of the zipper arrangement coupled such that the garment is partially closed.
Figure 11:
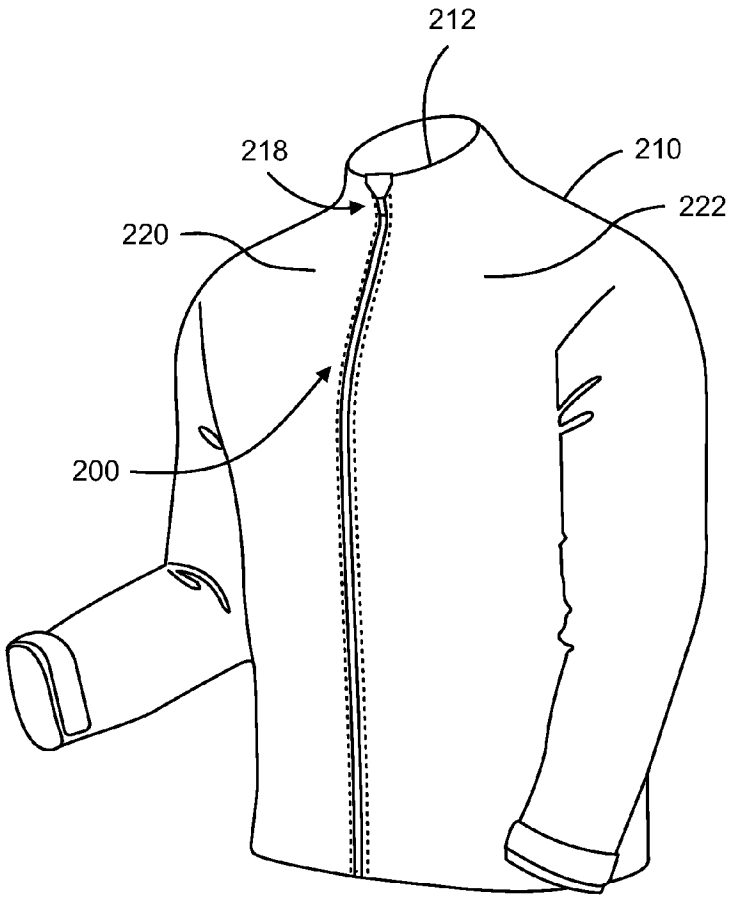
FIG. 11 shows a perspective view of a garment with a comfort zipper arrangement which extends to top of the garment.
Figure 13:
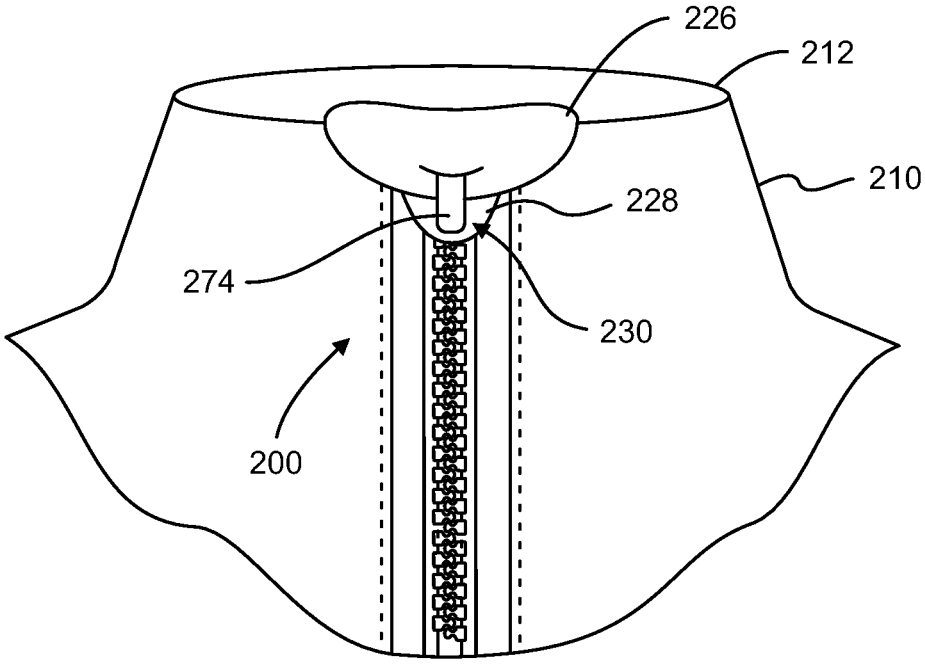
FIG. 13 shows a front view of the comfort zipper arrangement of FIG. 11 with a slider pulled to the top of the garment and folded over the slider.

Referring now to FIGS. 11 to 13, a zipper arrangement 200 is shown provided on a garment 210. Similar to the zipper arrangement 12 (see FIG. 1), the zipper arrangement 200 is provided on front of the garment 210. A slider assembly 218 is provided which is configured to engage two halves of the zipper arrangement 200 together.

The garment 210, similar to the garment 10 (see FIG. 1), includes a front right portion 220 and a front left portion 222. The garment 210 also includes a collar 212 at the neck portion of the garment 210. The front right portion 220 and the front left portion 222 generally extend from the bottom to the top of the garment 210, and particularly to the collar 212. The garment 210 may take any of various forms, such as a coat, a shirt, pants, or any other garment that may have one or more portions with edges to be releasably coupled together with the zipper arrangement 200. Furthermore, while various embodiments of the zipper arrangement 200 have been shown herein in association with a garment 210, it will be recognized that the zipper arrangement 200 may be used in association with numerous other articles in other embodiments, including for example, bags, shoes, tents, etc.

The slider assembly 218 includes a slider 228 with a pull member in the form of pull tab 226 coupled to the slider 228. The slider 228 includes a front side 230, a back side (not shown) and a top side 232. The front side 230 of the slider 228 generally faces the outside of the garment 210, the back side of the slider 228 generally faces the inside of the garment 210, and the top side 232 of the slider 228 generally faces the top of the garment (i.e., the top edge of the collar 212).

A stud 274 or other coupling member is provided on the front side 230 of the slider 228. The stud 274 extends through a hole 276 near the top end of the pull tab 226 and couples the pull tab 226 to the slider 228. The hole 276 of the pull tab 226 cooperates with the stud 274 of the slider 228 and allows the pull tab 226 to swivel according to an arrow 288.

The pull tab 226 is comprised of a generally flexible material such as a textile. For example, the pull tab 226 may be comprised of a cotton material, polyester material, blend, or other textile material that humans generally find comfortable against their skin. In other embodiments, the pull tab may be comprised of a flexible polymer material, or any of various other materials known in the art. The pull tab 226 is generally designed and dimensioned to be easily grasped by the fingers of a human. Accordingly, the pull tab 226 has a shape and size that will receive a substantial portion of the pads of a human's finger and thumb. Moreover, as described in further detail below, the pull tab 226 is sufficiently sized such that it may be pulled up and over the top side 232 of the slider 218 and brought into contact with the back side of the slider 218 or the inside of the collar 212. In the embodiment of FIG. 12, the pull tab 226 has a generally oval or egg shape. However, it will be recognized that in other embodiments the pull tab 226 may be differently shaped.

As shown in FIG. 12, the pull tab 226 includes a first retainer member 290 positioned toward the bottom end of the pull tab 226. The first retainer member 290 is shown in phantom in FIG. 12, and can be provided in any of a number of different embodiments. For example, in at least one embodiment, the first retainer member 290 is provided in the form of a magnet member positioned within the pull tab 226 (e.g., in a pocket in the pull tab) or on the surface of the pull tab 226. In other exemplary embodiments, the first retainer member 290 may be a snap (not shown) positioned on the surface of the pull tab 226, a hook and loop fastener member (not shown), or other types of attachment mechanisms well known to one of ordinary skill in the art.

A second retainer member (not shown) that is complementary to the first retainer member 290 is provided on the inside of the garment 210. The first retainer member 290 is configured to be releasably coupled to the second retainer member. For example, if the first retainer member 290 on the pull tab 226 is a magnet, the second retainer member may be a complementary magnetic member positioned on the inside of the collar 212. In at least one embodiment, the complementary magnetic member is simply the back side of the slider 218, the slider 218 being comprised of a steel or other magnetic metal material. In at least one alternative embodiment, the first retainer member 290 may be a loop portion of a hook and loop fastener, and the second retainer member may be a hook portion of the hook and loop fastener positioned on the back of the slider 218 or the inside of the collar 212. In yet another exemplary embodiment, the first retainer member 290 may be the button of a snap, and the second retainer member may be the recess portion of the snap. While a few possible embodiments of the first and second retainer members are disclosed herein, it will be recognized that numerous additional embodiments are possible.

Operation of the zipper arrangement 200 is described with reference to FIG. 13, which shows a front view of the zipper arrangement 200 with the pull tab 226 pulled to the top of the garment 210 and folded inward. In general the wearer can grip the pull tab 226 and swing the pull tab 226 upward or downward with respect to the slider 228 in order to pull the slider 228 up or down, respectively. Once the wearer pulls the slider 228 to top of the collar 212, the wearer can fold the pull tab 226 upward over the top side 232 of the slider 228, and inward between the zipper arrangement 200 and the skin, and particularly to a location on the inside of the collar 212.

Because of the folded position of the pull tab 226 covering the top side 232 of the slider 228, the pull tab 226 can provide comfort to the wearer against the inside surface of the slider 228 and other components of the zipper arrangement 200. As discussed previously, the pull tab 226 may be constructed from a soft material that provides the desired comfort. In at least one embodiment, the soft material is a textile, such as a cotton or polyester material. In addition, the pull tab 226, in its folded position, can insulate the slider 228 from the skin of the wearer which can be particularly important in cold weather where the slider 228 can feel cold to the wearer.

The first retainer member 290 can be used to maintain position of the pull tab 226 in its folded arrangement. As discussed above, the first retainer member 290 can be in the form of a magnetic strip that is sown within the pull tab 226 and is thereby configured to magnetically interface with the inside surface of the slider 228. Alternatively, the first retainer member 290 can be a button (not shown) that can be snapped with a complementary button (not shown) positioned on the inside surface of the slider 228. Other arrangements for the retainer 290 are also possible, e.g., complementary hook and loop members positioned on the pull tab 226 and the inside surface of the slider 228 or the inside surface of the collar 212.

While the foregoing provides a few alternative embodiments of the zipper arrangements 12, 100, and 200, it will be recognized that numerous other alternative embodiments for the zipper arrangement are possible, including additional alternative embodiments that relate to the slider 28 and the insertion pin assembly 24. For example, in one alternative embodiment, the slider 28 and the insertion pin assembly 24 may be formed from magnetic material with complementary poles that can generate a magnetic force to assist in bringing the slider 28 and the insertion pin assembly 24 together.

The foregoing example embodiments are but a few of numerous possible embodiments for the zipper arrangement, and it will be recognized that numerous additional embodiments are also possible and the foregoing embodiments should not be considered as limiting in any way. It will also be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. A zipper arrangement comprising:

a plurality of zipper elements extending between an upper end and a lower end of the zipper arrangement;

a slider configured to slide along the plurality of zipper elements between the upper end and the lower end of the zipper arrangement, the slider including a front side, a back side, and a top side;

a pull member comprised of a flexible material coupled to the front side of the slider, wherein the flexible material of the pull member is designed and dimensioned to extend over the top of the slider and to be releasably coupled to a position proximate the back side of the slider when the slider is at the upper end of the zipper arrangement; and a coupling member provided on the pull member, the coupling member designed to engage the position proximate the back side of the slider and releasably couple the pull member to the position proximate the back side of the slider.

2. The zipper arrangement of claim 1 wherein the position proximate the back side of the slider is provided on a surface of the back side of the slider.

3. The zipper arrangement of claim 1 wherein the position proximate the back side of the slider is an inner portion of a collar.

4. The zipper arrangement of claim 1 wherein the pull member is configured to be releasably coupled to the position proximate the back side of the slider with a magnet provided on at least one of the pull member and the slider.

5. The zipper arrangement of claim 1 wherein the pull member is configured to be releasably coupled to the position proximate the back side of the slider with a hook and loop fastener.

6. The zipper arrangement of claim 1 wherein the flexible material of the pull member is comprised of a textile.

7. The zipper arrangement of claim 1 wherein the pull member is pivotably coupled to the slider.

8. A garment comprising a collar;

a plurality of right zipper elements provided along a front right portion;

a plurality of left zipper elements provided along a front left portion;

a slider including a front side, a top side, and a back side, the slider configured to slide up as far as the collar and bring the plurality of right zipper elements into engagement with the plurality of left zipper elements, the slider further configured to slide down and disengage the plurality of right zipper elements from the plurality of left zipper elements;

a flexible pull member coupled to the slider, wherein the flexible pull member is designed and dimensioned to extend over the top side of the slider and be releasably coupled to an inner portion of the garment when the slider is at the collar; and a coupling member provided on the flexible pull member, the coupling member designed to releasably couple the pull member to the inner portion of the garment.

9. The garment of claim 8 wherein the inner portion of the garment is an inside portion of the collar.

10. The garment of claim 8 wherein the inner portion of the garment is the back side of the slider.

11. The garment of claim 8 wherein the coupling member is a magnet.

12. The zipper arrangement of claim 8 wherein the flexible pull member is configured to be releasably coupled to the inner portion of the garment with a hook and loop fastener.

13. The zipper arrangement of claim 8 wherein the flexible pull member is comprised of a flat material.

14. The zipper arrangement of claim 13 wherein the flexible pull member is comprised of a textile.

15. The zipper arrangement of claim 8 wherein the flexible pull member is pivotably coupled to the slider.

16. A method of closing a garment comprising:

moving a slider in an upward direction on the garment in order to engage a plurality of right zipper elements with a plurality of left zipper elements provided on a front of the garment;

folding a pull member comprised of a flexible material over an upper portion of the slider, the pull member coupled to a front side of the slider, the flexible material of the pull member designed and dimensioned to be folded over the slider and to be releasably coupled to an inner portion of the garment at a position proximate a back side of the slider; and coupling the flexible material of the pull member to the inner portion of the garment with a coupling member provided on the pull member.

17. The method of claim 16 further comprising stopping movement of the slider in the upward direction when the slider reaches a collar of the garment before folding the pull member over the upper portion of the slider.

18. The method of claim 17 wherein coupling the flexible material of the pull member to an inner portion of the garment when the slider is at the collar comprises engaging the pull member with an inner portion of the garment other than the zipper elements.

19. The method of claim 18 wherein coupling the flexible material of the pull member to the inner portion of the garment comprises magnetically coupling the flexible material of the pull member to the back side of the slider.

* * * * *